US010165353B2

(12) United States Patent
Schunack et al.

(10) Patent No.: US 10,165,353 B2
(45) Date of Patent: Dec. 25, 2018

(54) ELECTROACOUSTIC SOUND TRANSDUCER, AND EARPHONE

(71) Applicant: Sennheiser electronic GmbH & Co. KG, Wedemark (DE)

(72) Inventors: David Schunack, Burgwedel (DE); Christian Grone, Wedemark (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 131 days.

(21) Appl. No.: 14/920,982

(22) Filed: Oct. 23, 2015

(65) Prior Publication Data

US 2016/0119703 A1 Apr. 28, 2016

(30) Foreign Application Priority Data

Oct. 23, 2014 (DE) ..... 10 2014 221 583

(51) Int. Cl.

| | |
|---|---|
| ***H04R 1/28*** | (2006.01) |
| *H04R 1/10* | (2006.01) |
| *H04R 5/033* | (2006.01) |
| *H04R 7/08* | (2006.01) |

(52) U.S. Cl.

CPC ..... *H04R 1/2834* (2013.01); *H04R 1/1008* (2013.01); *H04R 1/1058* (2013.01); *H04R 1/1075* (2013.01); *H04R 5/033* (2013.01); *H04R 7/08* (2013.01)

(58) Field of Classification Search

CPC ... H04R 7/00; H04R 7/02; H04R 7/04; H04R 7/045; H04R 7/06; H04R 7/08; H04R 7/10; H04R 7/26; H04R 1/20; H04R 1/22; H04R 1/227; H04R 1/24; H04R 1/26; H04R 1/28; H04R 1/2803; H04R 1/2807; H04R 1/2811; H04R 1/2815; H04R 1/283; H04R 1/2834; H04R 1/1008

USPC ..... 381/335, 336, 152, 338, 339, 349, 345, 381/342, 347, 348, 182, 370, 371, 372, 381/373, 180, 424, 423

See application file for complete search history.

(56) References Cited

U.S. PATENT DOCUMENTS

| | | | | |
|---|---|---|---|---|
| 3,084,229 A * | 4/1963 | Brettell | ..... | H04R 19/02 381/191 |
| 4,005,278 A * | 1/1977 | Gorike | ..... | H04R 5/033 181/137 |
| 4,160,135 A | 7/1979 | Görike | | |

(Continued)

FOREIGN PATENT DOCUMENTS

| | | |
|---|---|---|
| EP | 0 589 623 | 3/1994 |
| EP | 2 287 608 | 1/2015 |

(Continued)

*Primary Examiner* — Oyesola C Ojo
(74) *Attorney, Agent, or Firm* — Haug Partners LLP

(57) ABSTRACT

An earphone is provided that has two diaphragms that are stretched on a frame and that are driven by means of an electroacoustic sound transducer that is not provided in the region of the two diaphragms. Instead, the sound transducer is acoustically coupled to the two diaphragms via a sound duct. The sound transducer preferably has a front and a rear volume, wherein the front volume of the sound transducer drives the two (parallel) diaphragms via the sound duct. This allows the provision of no electroacoustic reproduction transducer in the central region of the earpiece of an earphone.

8 Claims, 7 Drawing Sheets

(56) References Cited

U.S. PATENT DOCUMENTS 4,278,852 A * 7/1981 Gorike ..... H04R 1/24 381/354
4,399,334 A * 8/1983 Kakiuchi ..... H04R 1/1008 181/157
4,809,811 A * 3/1989 Gorike ..... H04R 1/2834 181/129
5,181,252 A * 1/1993 Sapiejewski ..... G10K 11/1788 181/166
6,831,984 B2 * 12/2004 Sapiejewski ..... H04R 1/2819 181/182
8,111,858 B2 * 2/2012 Sapiejewski ..... H04R 1/1083 381/370
8,139,806 B2 * 3/2012 Hosaka ..... H04R 1/2842 381/370
8,660,288 B2 * 2/2014 Yamagishi ..... H04R 1/22 381/182
8,737,665 B2 * 5/2014 Chung ..... H04R 1/1016 381/354
9,294,841 B2 * 3/2016 Sahyoun ..... H04R 1/2834
9,430,921 B2 * 8/2016 Biggs ..... G08B 6/00
9,906,850 B2 * 2/2018 Gleissner ..... H04R 1/1008
2003/0210801 A1 * 11/2003 Naksen ..... H04R 1/1066 381/370
2006/0188121 A1 * 8/2006 Tsunoda ..... H04R 1/1016 381/374
2015/0281850 A1 * 10/2015 Wang ..... H04R 3/14 381/74
2016/0198269 A1 * 7/2016 Ando ..... H04R 5/033 381/59
2016/0353191 A1 * 12/2016 Oishi ..... H04R 1/10

FOREIGN PATENT DOCUMENTS

EP 1879424 B1 * 9/2016 ..... H04R 1/1075
GB 2454605 A * 5/2009 ..... H04R 1/1083
WO WO 2016166785 A1 * 10/2016 ..... H04R 1/10

* cited by examiner

ELECTROACOUSTIC SOUND TRANSDUCER, AND EARPHONE

The present application claims priority to German Patent Application No. DE 10 2014 221 583.8 filed on Oct. 23, 2014, the disclosures of which are incorporated herein by reference in their entirety.

FIELD OF THE INVENTION

The present invention relates to an electroacoustic sound transducer and to an earphone.

A large number of different electroacoustic sound transducers, such as electrostatic or electrodynamic sound transducers, are known.

In the priority-establishing German patent application, the German Patent and Trademark Office has performed a search for the following documents: EP 2 827 608 A1; US 4,160,135 A and EP 0 589 623 A2.

SUMMARY OF THE INVENTION

It is an object of the present invention to provide an electroacoustic sound transducer for an earphone that allows the earpieces of an earphone to be embodied in shallower form.

Hence, an earphone is provided that has two diaphragms that are stretched on a frame and that are driven by means of an electroacoustic sound transducer that is not provided in the region of the two diaphragms. Instead, the sound transducer is acoustically coupled to the two diaphragms via a sound duct. The sound transducer preferably has a front and a rear volume, wherein the front volume of the sound transducer drives the two (parallel) diaphragms via the sound duct. This allows the provision of no electroacoustic reproduction transducer in the central region of the earpiece of an earphone, so that when transparent foils are used as diaphragms, for example, the ear may be visible from the outside and the housing of the earpiece may be embodied in shallower form. Optionally, the electroacoustic reproduction transducer may be coupled to the outside via a base tube.

According to one aspect of the present invention, the electroacoustic reproduction transducer may be provided in or on a fork for the earpiece, the earpiece being able to be coupled to a headband by means of the fork.

According to a further aspect of the present invention, a plurality of electroacoustic reproduction transducers may be coupled to the volume between the parallel diaphragms, for example by means of sound duct units, in order to be able to excite the diaphragms.

The invention likewise relates to an electroacoustic transducer having the features described above.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
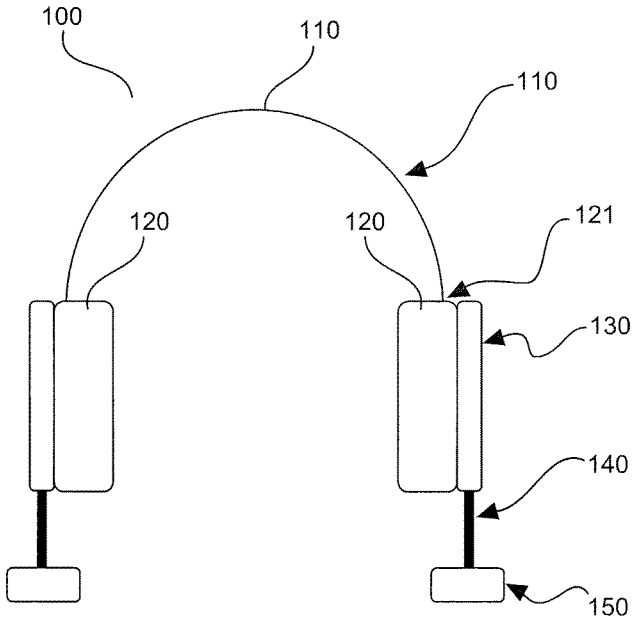
FIG. 1 shows a schematic illustration of an earphone according to a first exemplary embodiment of the invention.

FIG. 1 shows a schematic illustration of an earphone according to a first exemplary embodiment of the invention. The earphone 100 according to the first exemplary embodiment has a headband 110, two earpieces 120, each with an ear cushion 121, a (transparent) sound transducer 130, a sound duct 140 and a sound generator 150. The sound generator 150 produces the sound to be reproduced and routes it to the (transparent) sound transducer 130 via the sound duct 140. The (transparent) sound transducer 130 has two diaphragms (optionally transparent) that are tensioned on a frame and can be excited by the sound generator 150 in order to be able to emit a sound past the ear cushions 120.

According to the invention, an electroacoustic transducer system having two diaphragms that are tensioned by means of a frame and produce a closed dipole is therefore provided. A sound duct is coupled inside the dipole. In particular, one end of a sound duct is coupled inside the dipole. The second end of the sound duct is coupled to the sound generator.

Optionally, the sound generator has a front volume that is coupled to the sound duct. The rear volume of the sound transducer can have a base tube for acoustic tuning.

Hence, a sound transducer system is provided in which the drive is physically separate from the sound-emitting area.

When a transparent foil is chosen as a diaphragm, the sound transducer or the earpiece of the earphone is then transparent. Optionally, the two diaphragms can be acoustically tuned differently. In this case, the outer diaphragm can have a greater thickness and rigidity in order to be able to influence the resonance behaviour and the energy emission. The acoustic impedance of the sound transducer is transformed. Hence, a sound transducer with a modified diaphragm area can be produced. The rear volume of the electroacoustic sound transducer can likewise be coupled to the dipole (the two parallel diaphragms) so as to be able to influence the acoustic properties of the earphone.

According to one aspect of the present invention, the sound generator may be provided beneath, beside or above the earpiece. Optionally, the sound generator may be provided in the upper region of the headphone earpiece. Optionally, a plurality of sound generators may be coupled to the volume between the two diaphragms. According to the invention, the earphone may be embodied as an over-ear earphone, an on-ear earphone or an in-ear earphone.

Figure 2:
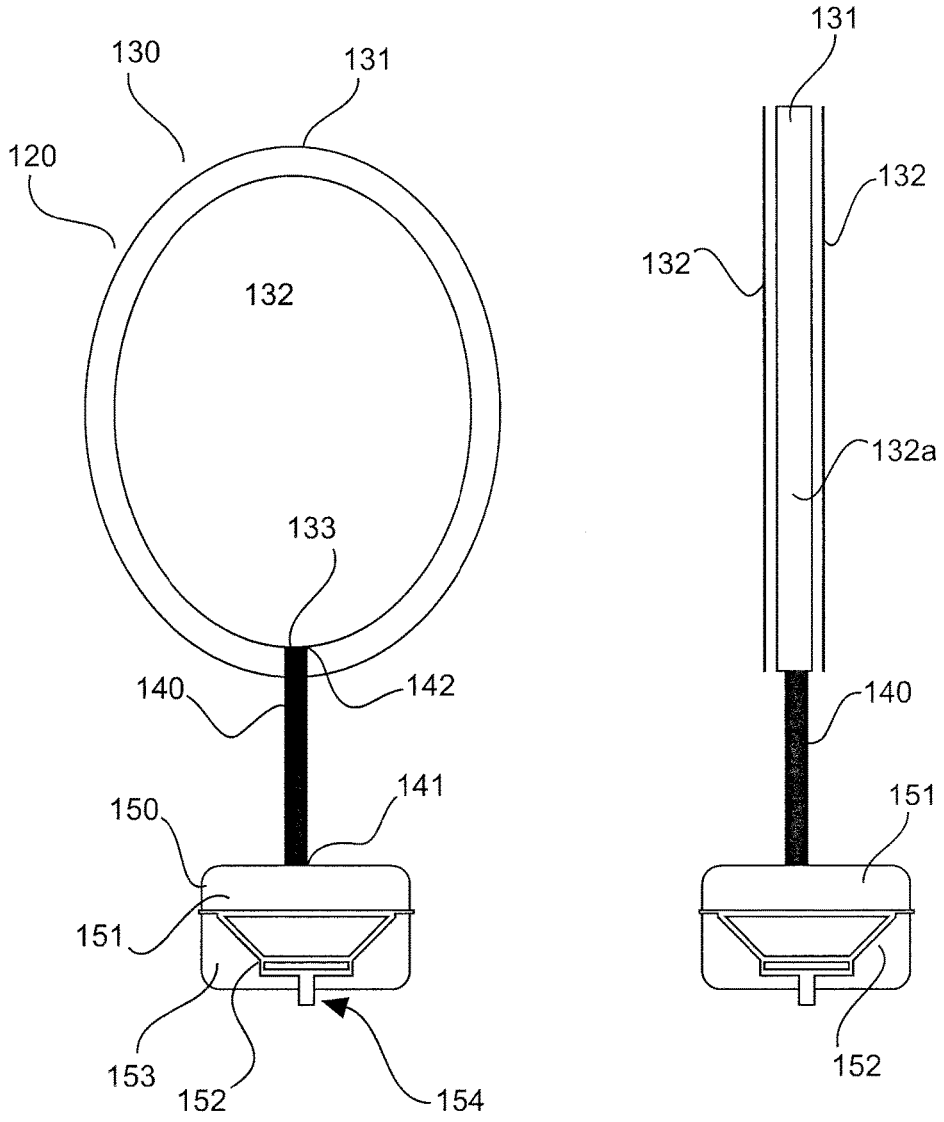
FIG. 2 shows a schematic illustration of an earphone according to a second exemplary embodiment.

FIG. 2 shows a schematic illustration of an earphone according to a second exemplary embodiment. The earphone has an earpiece 120 having a frame 131 on which two parallel diaphragms 132 (e.g. transparent foils) (on opposite sides of the frame 131) are tensioned. A sound duct 140 can be used to couple the sound from an electroacoustic transducer 150 into the volume 132*a* between the two diaphragms 132. The transducer 150 is optionally provided outside the frame 131. An opening 133 may be provided in the frame 131. The sound duct 140 has a first end 141, which is coupled to a front volume 151 of the transducer 150, and a second end 142, which is coupled to the opening 133. The opening 133 is coupling for the sound, which reaches the inside of the frame from the transducer 150 via the sound duct 140. The electroacoustic sound transducer 150 may optionally have a bass tube 154 for tuning the electroacoustic properties. Optionally, capillary openings may be provided for the purpose of compensating for pressure fluctuations.

According to one aspect of the present invention, the sound generator 150 may be integrated in the housing of the earpiece or of the headband.

Figure 3:
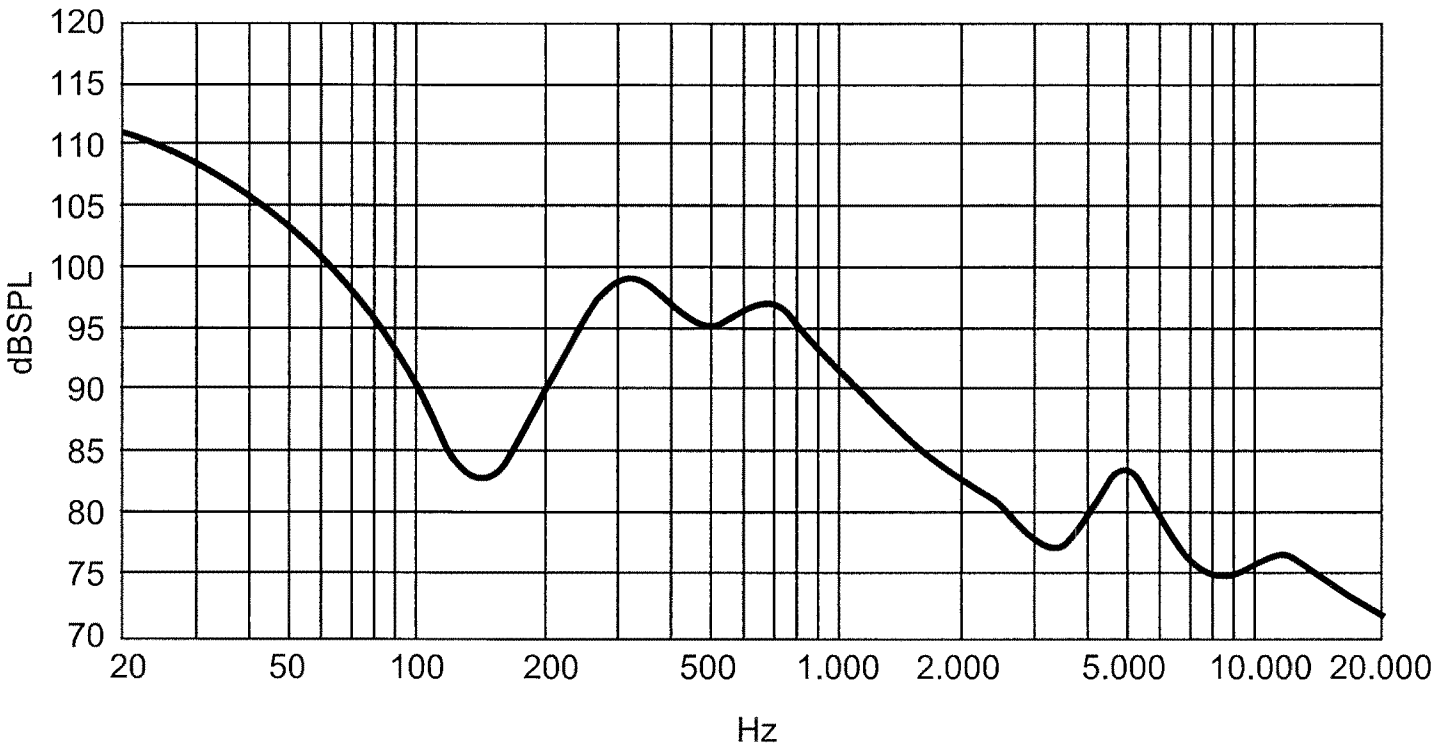
FIG. 3 shows a frequency response for an earphone according to the invention.

FIG. 3 shows a frequency response for an earphone according to the invention. In order to improve the frequency response of the earphone according to the invention, the volumes can be opened to produce the inner listening volume. Optionally, it is possible, to this end, for openings having acoustic attenuations to be provided, for example in adjustable form.

Figure 4:
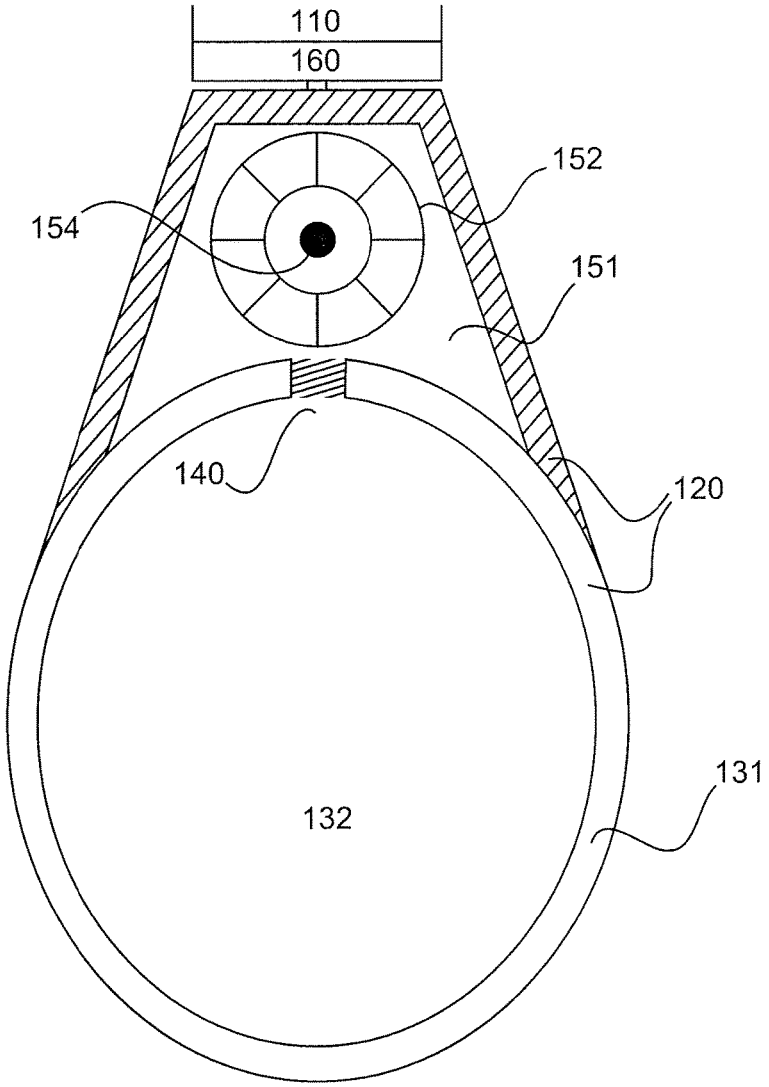
FIG. 4 shows a schematic sectional view of an earphone according to a third exemplary embodiment of the invention.

FIG. 4 shows a schematic sectional view of an earphone according to a third exemplary embodiment of the invention. An earphone earpiece 120 may be connected to one end of the headband 110 by means of an articulation 160. The upper region of the earphone earpiece 120 can contain the sound generator 150 with a front volume 151, an electrodynamic sound transducer 152, a rear volume 152 and a bass tube 154. Between the front volume 151 of the sound generator 150 and a volume 132*a* between the two diaphragms 132 that are tensioned on a frame 131, there may be a sound duct unit 140 provided, e.g. in the form of a sound inlet 141. Hence, just the front volume 151 of the sound transducer 150 is coupled to the volume 132*a* between the diaphragms 132. This means that the upper region of the earphone earpiece 120 has a volume with an electrodynamic sound transducer. Preferably, the rear volume of the electroacoustic reproduction transducer 152 can be routed or vented to the outside via a bass tube 154. By way of example, the electrodynamic sound transducer 152 can have a diameter of between 32 and 38 mm.

Figure 5:
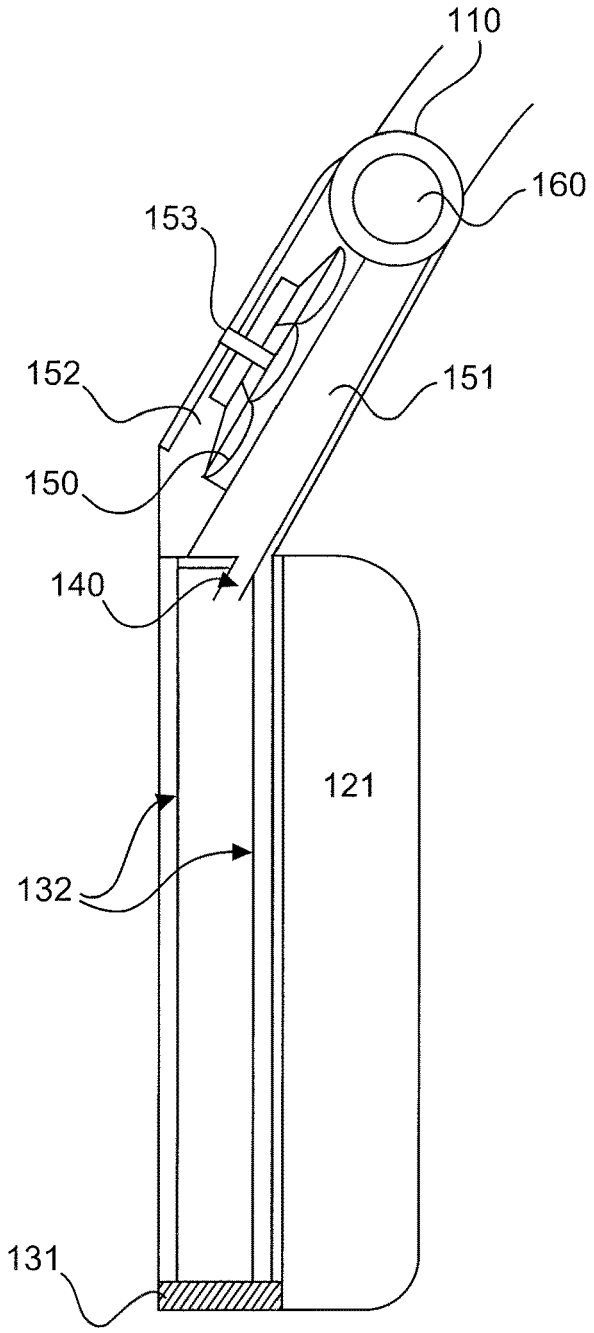
FIG. 5 shows a schematic sectional view of an earphone according to a fourth exemplary embodiment.

FIG. 5 shows a schematic sectional view of an earphone according to a fourth exemplary embodiment. FIG. 5 shows a further sectional view of the earphone from FIG. 4.

Figure 6A:
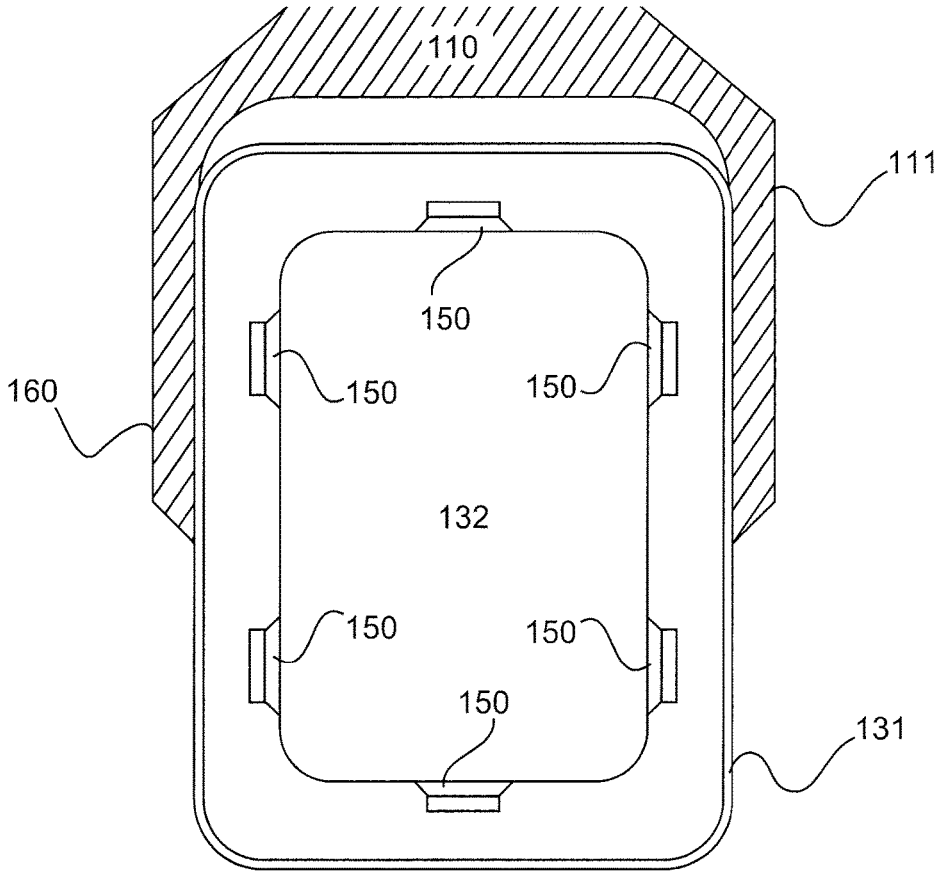
FIGS. 6A and 6B show two schematic views of an earphone according to a fifth and exemplary embodiment.
Figure 6B:
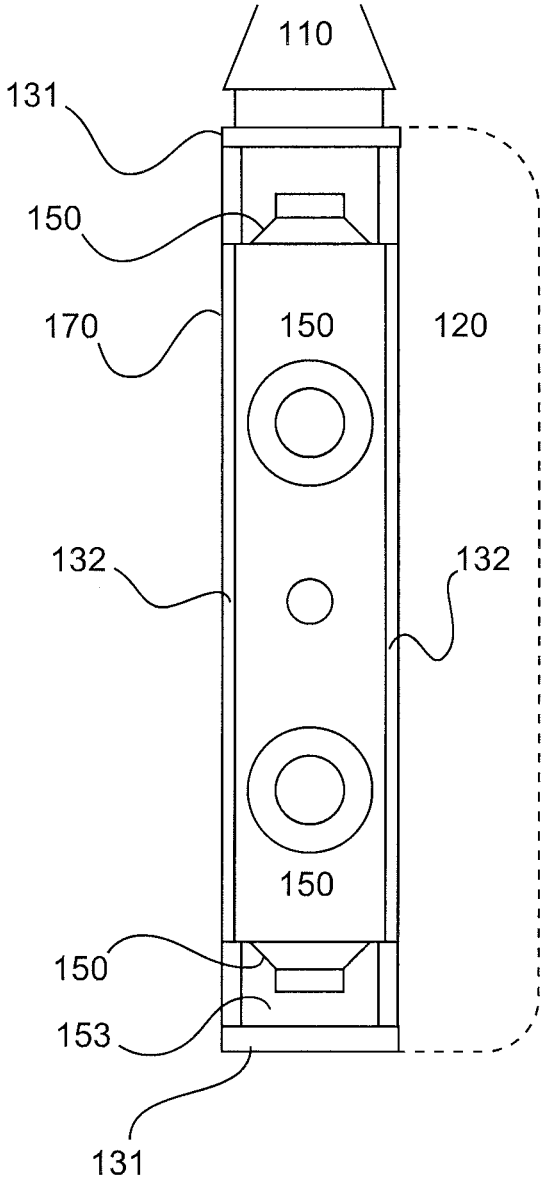

FIGS. 6*a* and 6*b* show two schematic views of an earphone according to a fifth exemplary embodiment. According to the fifth exemplary embodiment, the earphone earpiece 120 may be embodied as a frame 131 and hence support the two diaphragms 132. Optionally, a plurality of sound transducers 150 may be provided at the perimeter of the diaphragms 132. The frame 131 preferably has a volume that can be vented via a bass tube. Optionally, the front diaphragm sides of the drivers can couple directly to the transparent transducer. In order to keep the diaphragm spacing as short as possible, the sound inlet may be smaller than the diameter of the electroacoustic reproduction transducers.

The rigidity of the two diaphragms 132 may be embodied differently.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. An earphone comprising:

a first earpiece comprising:

a frame with an opening;

an ear cushion; and two diaphragms arranged parallel to each other on opposite sides of the frame and defining a first volume inside of the frame and between the two diaphragms;

at least one electroacoustic reproduction transducer with a front volume; and a sound duct with a first end and a second end;

wherein the electroacoustic reproduction transducer is physically separate from the two diaphragms;

wherein the first end of the sound duct is coupled to the front volume of the electroacoustic reproduction transducer and the second end of the sound duct is coupled to the opening of the frame so that sound from the electroacoustic reproduction transducer is coupled into the first volume via the sound duct and the two diaphragms are driven by the electroacoustic reproduction transducer; and wherein one of the two diaphragms is positioned toward an ear of a user when the earphone is worn by a user to emit sound past the ear cushon.

2. The earphone according to claim 1;

wherein each of the two diaphragms is transparent.

3. The earphone according to claim 1;

wherein the electroacoustic sound transducer is provided in a housing of the first earpiece.

4. The earphone according to claim 1, further comprising:

a second earpiece; and a band that is provided between the first and second earpieces and supports the first and second earpieces;

wherein the at least one electroacoustic reproduction transducer is provided in a housing of the first earpiece between the frame of the first earpiece and the band.

5. The earphone according to claim 1;

wherein the electroacoustic reproduction transduces further comprises a rear volume and the rear volume of the reproduction transducer is coupled to an outside via a bass tube.

6. The earphone according to claim 1;

wherein the two diaphragms have different rigidities.

7. An electroacoustic sound transducer unit comprising:

a frame with an opening;

two diaphragms arranged parallel to each other on opposite sides of the frame and defining a first volume inside of the frame and between the two diaphrams;

at least one electroacoustic reproduction transducer with a front volume; and a sound duct with a first end and a second end;

wherein the electroacoustic reproduction transducer is physically separate from the two diaphragms; and wherein the first end of the sound duct is coupled to the front volume of the electroacoustic reproduction transducer and the second end of the sound duct is coupled to the opening of the frame so that sound from the electroacoustic reproduction transducer is coupled into the first volume via the sound duct and the two diaphragms are driven by the reproduction transducer; and wherein one of the two diaphragms is positioned toward an ear of a user when the earphone is worn by a user to emit sound to the ear of the user.

8. The earphone according to claim 1;

wherein the sound duct is provided in the form of a sound inlet that is smaller than a diameter of the electroacoustic reproduction transducer.

* * * * *